US011186991B2

(12) United States Patent
Xing et al.

(10) Patent No.: US 11,186,991 B2
(45) Date of Patent: Nov. 30, 2021

(54) EARLY WARNING DEVICE AND DUCTILITY CONTROL METHOD FOR PRESTRESSED FRP REINFORCED STRUCTURE

(71) Applicant: SHENZHEN UINIVERSITY, Shenzhen (CN)

(72) Inventors: Feng Xing, Shenzhen (CN); Yingwu Zhou, Shenzhen (CN); Lili Sui, Shenzhen (CN); Zhenyu Huang, Shenzhen (CN); Xiaowei Wang, Shenzhen (CN)

(73) Assignee: SHENZHEN UNIVERSITY, Guangdong (CN)

( * ) Notice: Subject to any disclaimer, the term of this patent is extended or adjusted under 35 U.S.C. 154(b) by 0 days.

(21) Appl. No.: 16/626,000

(22) PCT Filed: Apr. 24, 2019

(86) PCT No.: PCT/CN2019/083983
§ 371 (c)(1),
(2) Date: Dec. 23, 2019

(87) PCT Pub. No.: WO2020/087887
PCT Pub. Date: May 7, 2020

(65) Prior Publication Data

US 2021/0131105 A1 May 6, 2021

(30) Foreign Application Priority Data

Oct. 31, 2018 (CN) ..... 201811283912.9
Oct. 31, 2018 (CN) ..... 201811283915.2

(51) Int. Cl.
*E04C 5/12* (2006.01)
*E04C 5/08* (2006.01)

(52) U.S. Cl.
CPC ..... *E04C 5/127* (2013.01); *E04C 5/085* (2013.01)

(58) Field of Classification Search
CPC . E04C 5/085; E04C 5/127; E04C 5/07; E04G 23/02; E04G 21/12
See application file for complete search history.

(56) References Cited

U.S. PATENT DOCUMENTS 6,385,940 B1 * 5/2002 Maier ..... E04G 23/0218 52/223.1
6,584,738 B1 * 7/2003 Andra ..... E04G 21/121 52/223.13

(Continued)

FOREIGN PATENT DOCUMENTS

CN 103321430 A 9/2013
CN 104895251 A 9/2015

(Continued)

OTHER PUBLICATIONS

International Search Report in corresponding International Appln. No. PCT/CN2019/083983 dated Oct. 31, 2018.

*Primary Examiner* — James M Ference
(74) *Attorney, Agent, or Firm* — Bacon & Thomas, PLLC

(57) ABSTRACT

The present invention provides an early warning device and a ductility control method for a prestressed FRP reinforced structure. By setting a tensioning screw, prestressed reinforcement can be converted into non-prestressed reinforcement when tensioning screw failure occurs, and the structure is still in a safe state. This can improve the bearing capacity and ductility of the reinforced structure, while the ductility can be controlled and designed, thereby resolving the problem of easy disconnection and brittle failure between the FRP and anchors, and greatly improving FRP utilization and structural safety.

19 Claims, 9 Drawing Sheets

(56) References Cited

U.S. PATENT DOCUMENTS

| | | | | |
|---|---|---|---|---|
| 7,441,380 | B2 * | 10/2008 | Andra | E04C 5/07 14/21 |
| 2005/0247016 | A1 * | 11/2005 | Andra | E04C 5/127 52/745.21 |
| 2005/0252116 | A1 * | 11/2005 | Maier | E04G 23/0218 52/223.1 |
| 2011/0072745 | A1 * | 3/2011 | Pantelides | E01D 19/16 52/223.13 |
| 2011/0197540 | A1 * | 8/2011 | Pantelides | E04C 5/127 52/698 |
| 2012/0227351 | A1 * | 9/2012 | James | E04B 1/4157 52/705 |
| 2013/0232895 | A1 * | 9/2013 | Berset | E04G 23/0218 52/223.8 |
| 2014/0360129 | A1 * | 12/2014 | Berset | E04G 23/0218 52/745.19 |
| 2015/0075101 | A1 * | 3/2015 | Semaan | E04C 5/06 52/514 |
| 2015/0267408 | A1 * | 9/2015 | Kurath-Grollmann | E04B 1/16 52/223.6 |
| 2017/0335568 | A1 * | 11/2017 | Schmidt | E04C 5/07 |
| 2018/0187438 | A1 * | 7/2018 | Schmidt | E04G 23/0218 |
| 2018/0370072 | A1 * | 12/2018 | Pfaff | E04C 5/073 |

FOREIGN PATENT DOCUMENTS

| | | | | |
|---|---|---|---|---|
| CN | 204899230 | U | 12/2015 | |
| CN | 205206350 | U | 5/2016 | |
| CN | 109235923 | A | 1/2019 | |
| CN | 109235924 | A | 1/2019 | |
| JP | 4303569 | B2 | 7/2009 | |
| JP | 2014227743 | A | 12/2014 | |
| KR | 2010066697 | A * | 6/2010 | E04C 5/085 |

* cited by examiner

EARLY WARNING DEVICE AND DUCTILITY CONTROL METHOD FOR PRESTRESSED FRP REINFORCED STRUCTURE

TECHNICAL FIELD

The present invention relates to the technical field of FRP reinforced concrete structures, in particular, to an early warning device and a ductility control method for a prestressed FRP reinforced structure.

BACKGROUND

With the development of concrete structure reinforced technologies, the excellent performance of FRP (Fiber Reinforced Polymer/Plastic) is well-known to a growing number of people, and FRP reinforced concrete structure is also favored by a growing number of people.

However, there are significant shortcomings in current FRP prestressed reinforced concrete structures: (1) poor ductility, although the bearing capacity is improved compared with ordinary concrete members, the ductility is reduced to a certain extent, thereby damaging the early warning effect; (2) anchor loosening and slippage of FRP, when prestress is applied on the prestressed FRP strips, the FRP strips and the anchor are prone to have a relative slippage; and as the stress increases, the FRP is detached from the anchor and the prestress failure occurs, thus not playing the reinforcement effect as it should; (3) a tensioning and anchoring device has a heavy structure, complicated process, high technical requirement and high cost, and cannot be reused.

Therefore, a technical problem to be resolved by those skilled in the art is how to provide a tensioning device and method for resolving the above-mentioned shortcomings of the FRP prestressed reinforced concrete structure in the prior art.

SUMMARY

The present invention provides an early warning device and a ductility control method for a prestressed FRP reinforced structure. The bearing capacity and ductility of the reinforced structure can be improved, while the problem of easy disconnection and brittle failure between the FRP and anchors can be resolved, thereby greatly improving FRP utilization rate and structural safety.

To achieve the above purpose, the present invention provides the following technical solutions.

The present invention discloses a tensioning screw early warning device for a prestressed FRP reinforced structure, including a fixing plate, an FRP strip, a self-locking plate, an anchoring plate, at least one screw, a nut, and an expansion bolt, where the fixing plate and the anchoring plate are located on both sides of the self-locking plate; one end of the FRP strip is fixedly connected to the fixing plate, and the other end of the FRP strip is fixedly connected to the self-locking plate; the at least one tensioning screw passes through the self-locking plate and the anchoring plate; there are a plurality of nuts, the plurality of nuts are in threaded connection to the tensioning screw, and the nuts are configured to lock on both sides of the self-locking plate and on both sides of the anchoring plate; the expansion bolt is configured to fasten the fixing plate, the self-locking plate, and the anchoring plate on a concrete matrix; and a through hole for mounting the expansion bolt on the self-locking plate is an oblong hole, and the oblong hole is disposed in parallel with the tensioning screw.

The present invention further discloses a single-screw early warning device for a prestressed FRP reinforced structure, including a fixing plate, an FRP strip, a self-locking plate, an anchoring plate, a tensioning screw, a nut, and an expansion bolt, where the fixing plate and the anchoring plate are located on both sides of the self-locking plate; one end of the FRP strip is fixedly connected to the fixing plate, and the other end of the FRP strip is fixedly connected to the self-locking plate; the tensioning screw passes through the self-locking plate and the anchoring plate; there are a plurality of nuts, the plurality of nuts are in threaded connection to the tensioning screw, and the nuts are configured to lock on both sides of the self-locking plate and on both sides of the anchoring plate; the expansion bolt is configured to fasten the fixing plate, the self-locking plate, and the anchoring plate on a concrete matrix; and a through hole for mounting the expansion bolt on the self-locking plate is an oblong hole, and the oblong hole is disposed in parallel with the tensioning screw.

Preferably, both the fixing plate and the self-locking plate are provided with two strip-shaped grooves parallel to each other, the strip-shaped grooves are used for the FRP strip to pass through, and both ends of the FRP strip are fixedly connected to the fixing plate and the self-locking plate through a self-locking winding structure.

Preferably, the self-locking plate is T-shaped and includes a connecting section and a fixing section, where the fixing section is perpendicular to the connecting section and is symmetrical about the connecting section, the connecting section is used for connecting one end of the FRP strip, the connecting section is provided with the strip-shaped grooves, and the fixing section is provided with the oblong hole.

Preferably, a center line of the FRP strip coincides with a center line of the tensioning screw.

Preferably, a length of the oblong hole is greater than twice a maximum elongation of the tensioning screw.

Preferably, an edge of the FRP strip is a smooth transition structure.

The present invention further discloses a ductility control method for a prestressed FRP reinforced structure, using the above single-screw early warning device and including the following steps:

S1. An anchoring plate is fastened on a concrete matrix through an expansion bolt;

S2. Both ends of an FRP strip are fastening on a fixing plate and a self-locking plate respectively; and S3. According to the design level of tension stress, a diameter and material of a tensioning screw are selected, the tensioning screw is passed through the anchoring plate and the self-locking plate, and the expansion bolt is passed through a midpoint of an oblong hole on the self-locking plate and fastened to the concrete matrix. At this time, a nut on the expansion bolt on the self-locking plate is not tightened, the nut is used to mutually lock the tensioning screw and the self-locking plate, at the same time, the nut of the expansion bolt on the fixing plate is tightened, and then a tensioning force is applied. When the tensioning force is pulled to the design level, the nut is used to mutually lock the tensioning screw and the anchoring plate, and finally the pulling is stopped.

Preferably, in step S2, both ends of the FRP strip are respectively fastened on the fixing plate and the self-locking plate through a self-locking winding manner.

The present invention further discloses a dual-screw early warning device for a prestressed FRP reinforced structure, including a fixing plate, an FRP strip, a self-locking plate, an anchoring plate, a tensioning plate, a tensioning screw, a nut, and an expansion bolt, where the tensioning plate includes a first tensioning plate and a second tensioning plate arranged in parallel; the fixing plate, the self-locking plate, the anchoring plate, and the tensioning plate are sequentially arranged from left to right; one end of the FRP strip is fixedly connected to the fixing plate, and the other end of the FRP strip is fixedly connected to the self-locking plate; the tensioning screw passes through the self-locking plate, the anchoring plate, and the tensioning plate; there are a plurality of nuts, the plurality of nuts are in threaded connection to the tensioning screw, and the nuts are configured to lock on both sides of the self-locking plate, on both sides of the anchoring plate, and on both sides of the tensioning plate; the expansion bolt is configured to fasten the fixing plate, the self-locking plate, and the anchoring plate on a concrete matrix; and a through hole for mounting the expansion bolt on the self-locking plate is an oblong hole, and the oblong hole is disposed in parallel with the tensioning screw.

Preferably, both the fixing plate and the self-locking plate are provided with two strip-shaped grooves parallel to each other, the strip-shaped grooves are used for the FRP strip to pass through, and both ends of the FRP strip are fixedly connected to the fixing plate and the self-locking plate through a self-locking winding structure.

Preferably, the self-locking plate is T-shaped and includes a connecting section and a fixing section, where the fixing section is perpendicular to the connecting section and is symmetrical about the connecting section, the connecting section is used for connecting one end of the FRP strip, the connecting section is provided with the strip-shaped grooves, and the fixing section is provided with the oblong hole.

Preferably, a center line of the FRP strip coincides with a center line of the tensioning screw, and a length of the oblong hole is greater than twice a maximum elongation of the tensioning screw.

Preferably, an edge of the FRP strip is a smooth transition structure.

The present invention further discloses a ductility control method for a prestressed FRP reinforced structure, using the above dual-screw early warning device and including the following steps:

S1. An anchoring plate is fastened on a concrete matrix through an expansion bolt;

S2. Both ends of an FRP strip are fastening on a fixing plate and a self-locking plate respectively; and S3. According to the design level of tension stress, a diameter and material of a tensioning screw are selected, the tensioning screw is passed through the self-locking plate, the anchoring plate, and the tensioning plate, a nut is used to mutually lock the tensioning screw and the self-locking plate, and the nut is used to mutually lock the tensioning screw and the tensioning plate;

S4. A distance between the tensioning plate and the anchoring plate is enlarged, thereby pulling the tensioning screw, when the tensioning force is pulled to the design level, the nut is used to mutually lock the tensioning screw and the anchoring plate, and finally the pulling is stopped; and S5. The expansion bolt is mounted on the concrete matrix through the oblong hole of the self-locking plate, and the expansion bolt is kept to be fastened on the center of the oblong hole of the self-locking plate, and meanwhile, the expansion bolt is not locked and tightened.

Preferably, in step S2, both ends of the FRP strip are respectively fastened on the fixing plate and the self-locking plate through a self-locking winding manner.

Preferably, in step S4, the distance between the tensioning plate and the anchoring plate is enlarged by a hydraulic jack.

Preferably, in step S4, a third tensioning screw is passed through the tensioning plate and the nut is used to mutually lock the third tensioning screw and the tensioning plate, and the distance between the tensioning plate and the anchoring plate is enlarged by pulling one end of the third tensioning screw away from the anchoring plate.

Compared with the prior art, the present invention achieves the following technical effects:

(1) the tensioning device has the advantages of simple structure, clear construction process, low technical requirements, low cost, and convenient construction, and is suitable for construction on site;

(2) the ductility of the prestressed concrete reinforced structure can be significantly improved and the problem of loosing between FRP strips and fixtures is resolved;

(3) the utilization rate of the FRP strip and the reliability of the reinforced device are improved, the FRP material is saved, and the cost is saved for reinforced projects;

(4) self-warning function of structural overload is achieved through elastoplastic deformation of the tensioning screw;

(5) the overall structure is easy to process and produce, can meet the needs of industrial production and facilitate large-scale promotion and application in the field of engineering reinforcement; and (6) when a dual-screw is used for tensioning, the overall stability is better and the loading process is smoother.

Figure 1:
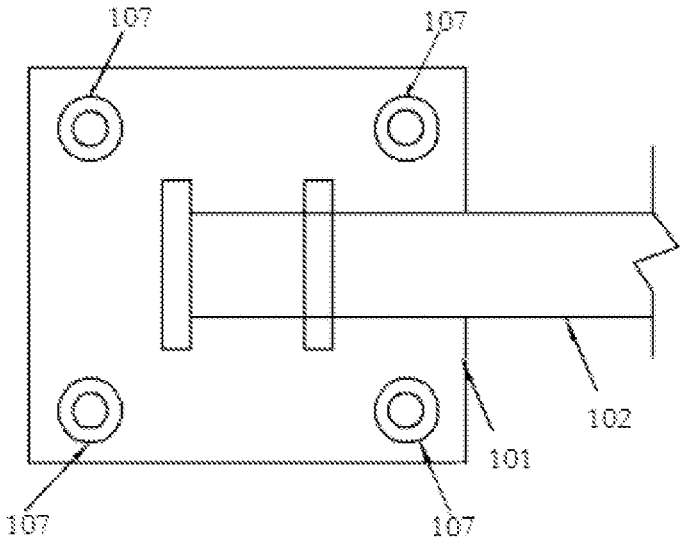
FIG. 1 is a top view showing a connection manner of one end of a fixing plate of a single-screw early warning device according to the present invention.
Figure 2:
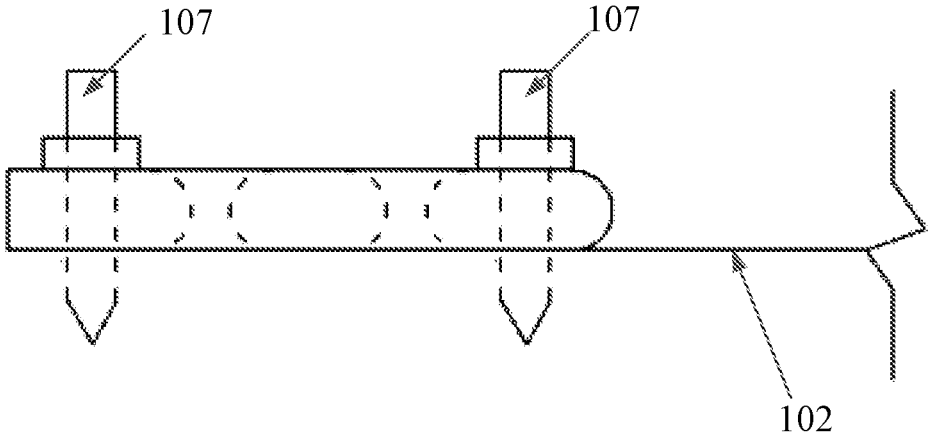
FIG. 2 is a side view showing a connection manner of one end of a fixing plate of a single-screw early warning device according to the present invention.
Figure 3:
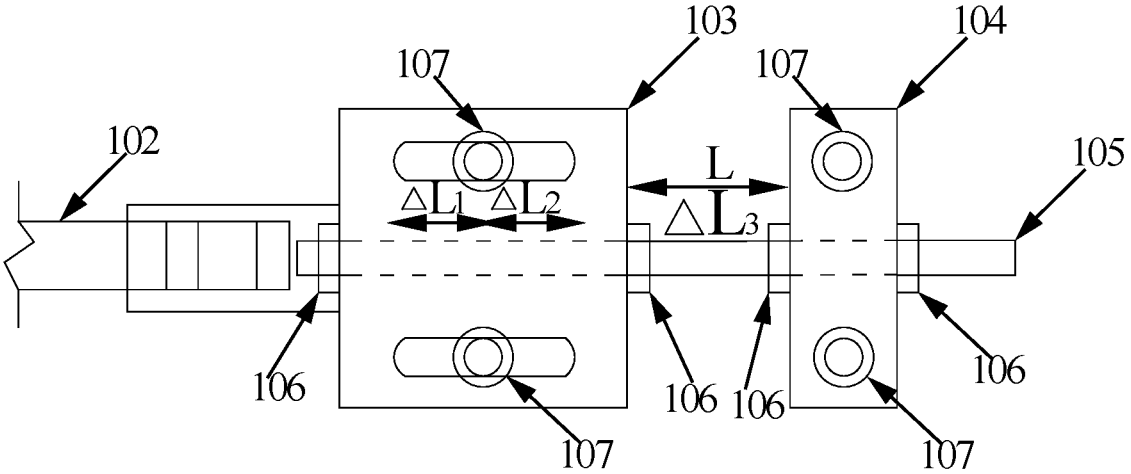
FIG. 3 is a top view showing a connection manner of one end of an anchoring plate of a single-screw early warning device according to the present invention.
Figure 4:
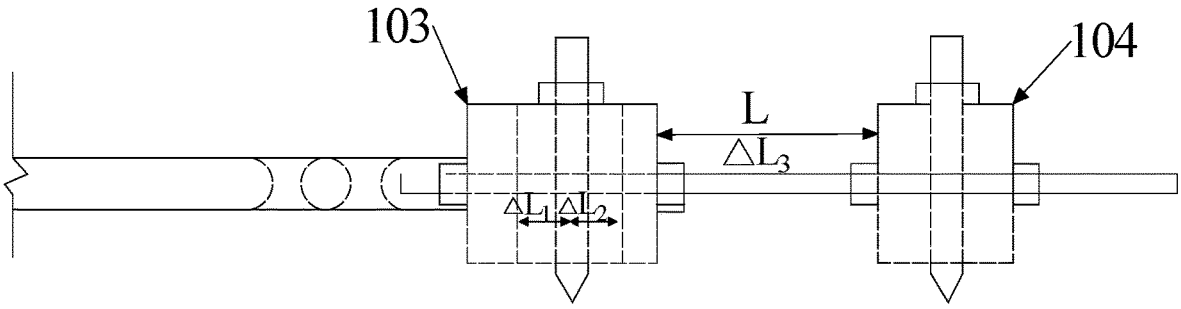
FIG. 4 is a side view showing a connection manner of one end of an anchoring plate of a single-screw early warning device according to the present invention.
Figure 5:
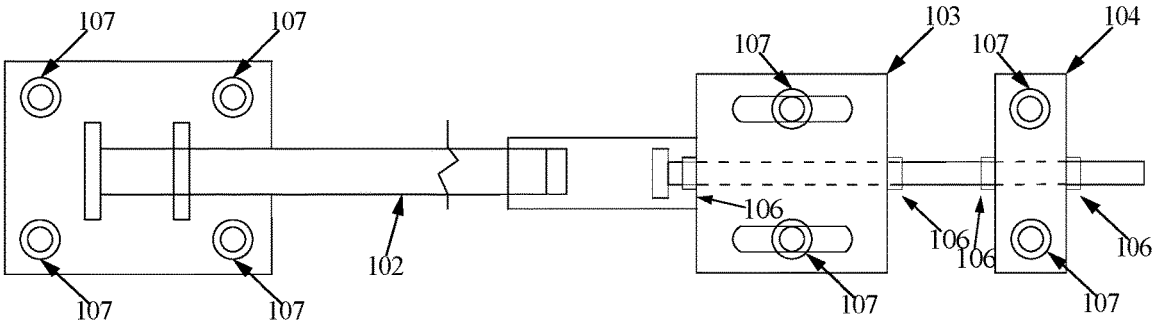
FIG. 5 is a top view of a single-screw early warning device according to the present invention.

Numbers in the accompanying drawings are described as follows: fixing plate 101, FRP strip 102, self-locking plate 103, anchoring plate 104, tensioning screw 105, nut 106, expansion bolt 107, fixing plate 201, FRP strip 202, self-locking plate 203, anchoring plate 204, tensioning plate 205, first tensioning screw 206, second tensioning screw 207, third tensioning screw 208, nut 209, expansion bolt 210, hydraulic jack 211, early warning device 301, and fixing device 302.

DETAILED DESCRIPTION

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

The present invention provides an early warning device and a ductility control method for a prestressed FRP reinforced structure. The bearing capacity and ductility of the reinforced structure can be improved, while the problem of easy disconnection and brittle failure between the FRP and anchors can be resolved, thereby greatly improving FRP utilization rate and structural safety.

To make the foregoing objective, features, and advantages of the present invention clearer and more comprehensible, the present invention is further described in detail below with reference to the accompanying drawings and specific embodiments.

Embodiment 1

This embodiment provides a tensioning screw early warning device for a prestressed FRP reinforced structure, including a fixing plate, an FRP strip, a self-locking plate, an anchoring plate, at least one tensioning screw, a nut, and an expansion bolt. The fixing plate and the anchoring plate are located on both sides of the self-locking plate; one end of the FRP strip is fixedly connected to the fixing plate, and the other end of the FRP strip is fixedly connected to the self-locking plate; the at least one tensioning screw passes through the self-locking plate and the anchoring plate; there are a plurality of nuts, the plurality of nuts are in threaded connection to the tensioning screw, and the nuts are configured to lock on both sides of the self-locking plate and on both sides of the anchoring plate; the expansion bolt is configured to fasten the fixing plate, the self-locking plate, and the anchoring plate on a concrete matrix; and a through hole for mounting the expansion bolt on the self-locking plate is an oblong hole, and the oblong hole is disposed in parallel with the tensioning screw.

There may be one or more of the foregoing tensioning screws. When there is one tensioning screw, the tensioning is convenient, and the tensioning screw can be directly tensioned; when there are a plurality of tensioning screws, in order to ensure that the tensioning screws are synchronously tensioned, one end of each tensioning screw away from the self-locking plate can pass through the anchoring plate and then pass through a tensioning plate, the nut is used to lock the tensioning screw on both ends of the tensioning plate, and synchronous tensioning of each tensioning screw can be achieved by moving the tensioning plate.

Figure 22:
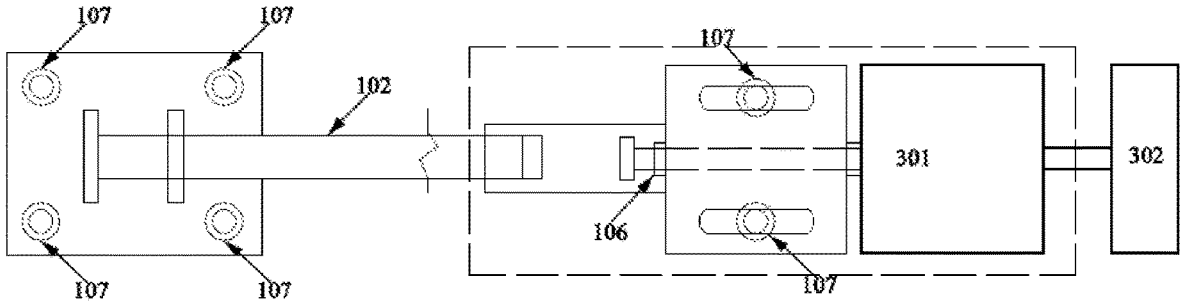
FIG. 22 is a schematic diagram of an inventive concept of an early warning device.

As shown in FIG. 22, this embodiment realizes ductility control by an early warning device 301 composed of a single or a plurality of tensioning screws, a self-locking plate, an anchoring plate, and a nut. The tensioning screws of early warning device 301 is replaceable, has various forms, and functions as a fuse. One end of the early warning device 301 is provided with a fixing device 302 fixedly connected to the early warning device 301. The fixing device 302 is configured to tension the tensioning screw and fasten one end of the tensioning screw after the tensioning is completed.

It should be noted that the tensioning screw and the self-locking plate are the key to ductility control of this embodiment. In this embodiment, the ductility of the overall structure is improved by the elongation of the tensioning screw, and the utilization rate of the FRP strip can be controlled by adjusting the material and diameter of the tensioning screw. The expansion bolt in the oblong hole of the self-locking plate is not locked until the tensioning screw is pulled to be broken, so that the self-locking plate can move to the right with the elongation of the tensioning screw, and can move to the left with the pulling of the FRP strip after the tensioning screw is pulled to be broken, thus moving to the left to the end of the oblong hole and then locking the expansion bolt. The overall structure is converted from prestressed reinforcement to non-prestressed reinforcement, and the structure is still in a safe state.

The material of the tensioning screw can be made of a shape memory alloy, and after plastic deformation occurs, the shape before deformation can be restored after a suitable thermal process. When the load loading degree is within a tolerance range of the screw, the entire tensioning device is tensioned and reinforced according to an expected effect, and can be reused by heating the tensioning screw after plastic deformation, thereby significantly saving cost. When the load loading degree is beyond the tolerance range of the screw, the tensioning screw is pulled to be broken and fails. At this time, the tensioning device can be reused only by replacing the fuse, so that the tensioning screw is similar to a "fuse" for protecting the entire tensioning device.

The FRP strip and the concrete matrix can be in two forms: bonding or non-bonding, which can be selected by those skilled in the art according to actual needs. It is calculated that, after the distance of the FRP strip from the ground is increased, the cross-section of the beam can be increased, and the bending stiffness can be increased. The tensioning device is relatively simple in installation and has relatively small damage to the original structure.

Embodiment 2

As shown in FIG. 1-8, this embodiment provides a single-screw early warning device for a prestressed FRP reinforced structure, which includes a fixing plate 101, an FRP strip 102, a self-locking plate 103, an anchoring plate 104, a tensioning screw 105, a nut 106, and an expansion bolt 107. The fixing plate 101, the self-locking plate 103, and the anchoring plate 104 are all low carbon steel structures. The FRP strip 102 is used for connecting the fixing plate 101 and the self-locking plate 103. The tensioning screw 105 is used for connecting the self-locking plate 103 and the anchoring plate 104. The nut 106 is connected to the tensioning screw 105 in a screw thread manner. The nut 106 is used to lock the tensioning screw 105 with the self-locking plate 103 and the anchoring plate 104. The expansion bolt 107 is used to fasten the fixing plate 101, the self-locking plate 103, and the anchoring plate 104 on the concrete matrix.

The fixing plate 101 and the anchoring plate 104 are respectively located on the left and right sides of the self-locking plate 103. One end of the FRP strip 102 is fixedly connected to the fixing plate 101, and the other end of the FRP strip 102 is fixedly connected to the self-locking plate 103. The tensioning screw 105 passes through the self-locking plate 103 and the anchoring plate 104. There are a plurality of nuts 106 used for locking the tensioning screws on both sides of the self-locking plate 103 and on both sides of the anchoring plate 104. The through-hole for mounting the expansion bolt 107 on the self-locking plate 103 is an oblong hole, and the oblong hole is disposed in parallel with the tensioning screw 105. The length of the oblong hole is more than twice the maximum elongation of the tensioning screw 105, which aims to fully exert the deformation of the tensioning screw 105, to fully utilize the elongation of the tensioning screw 105 to improve the ductility of the entire member.

Figure 7:
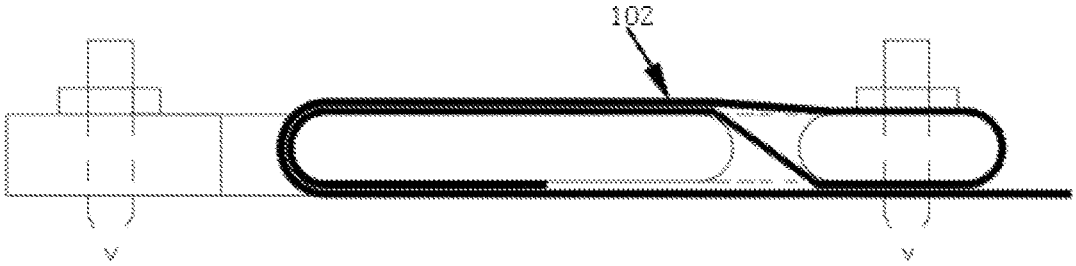
FIG. 7 is a schematic diagram showing a fixing manner of an FRP strip on one end of a fixing plate of a single-screw early warning device according to the present invention.
Figure 8:
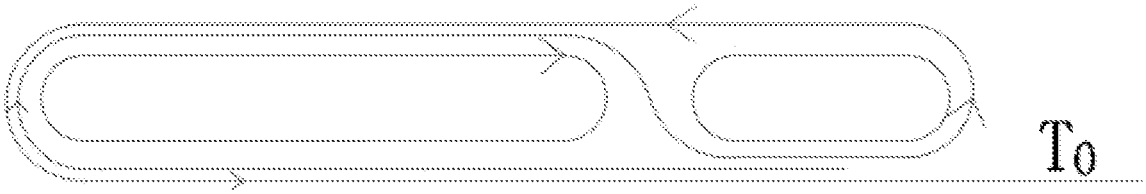
FIG. 8 is a simplified schematic diagram of FIG. 7.
Figure 9:
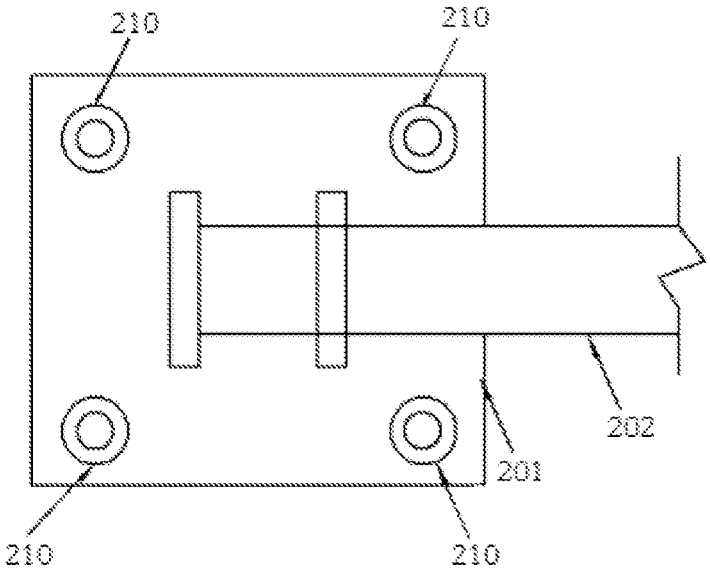
FIG. 9 is a top view showing a connection manner of one end of a fixing plate of a dual-screw early warning device according to the present invention.
Figure 10:
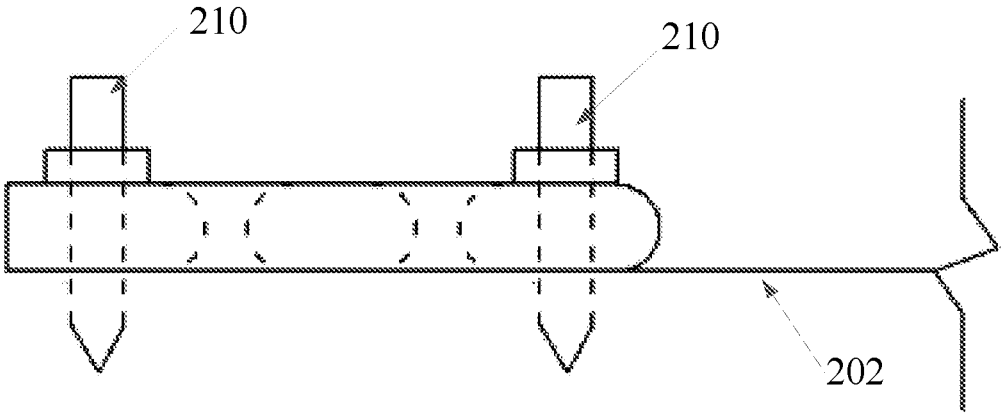
FIG. 10 is a side view showing a connection manner of one end of a fixing plate of a dual-screw early warning device according to the present invention.
Figure 11:
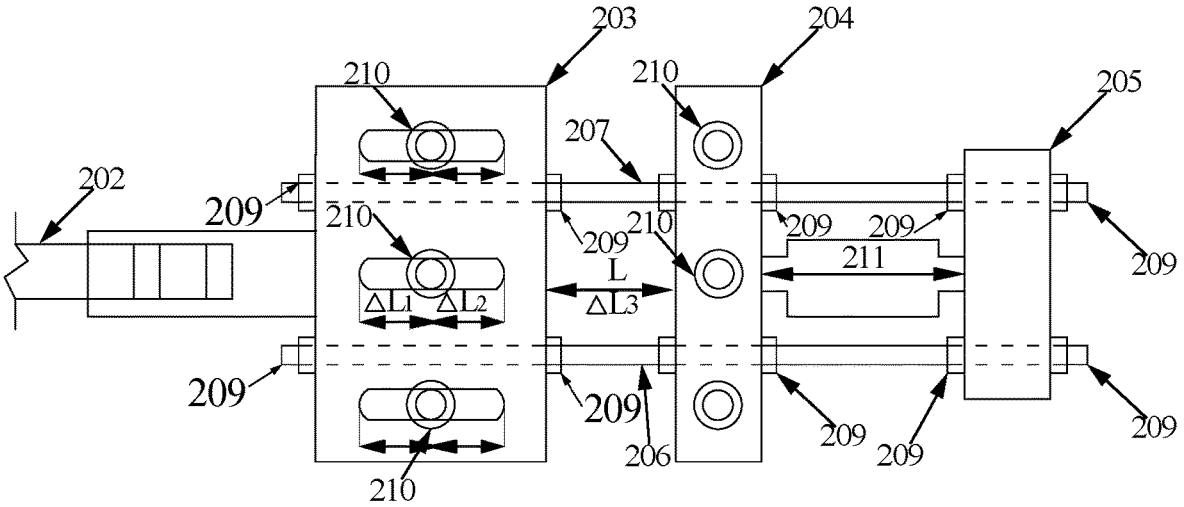
FIG. 11 is a top view showing a connection manner of one end of an anchoring plate of a dual-screw early warning device according to the present invention.
Figure 12:
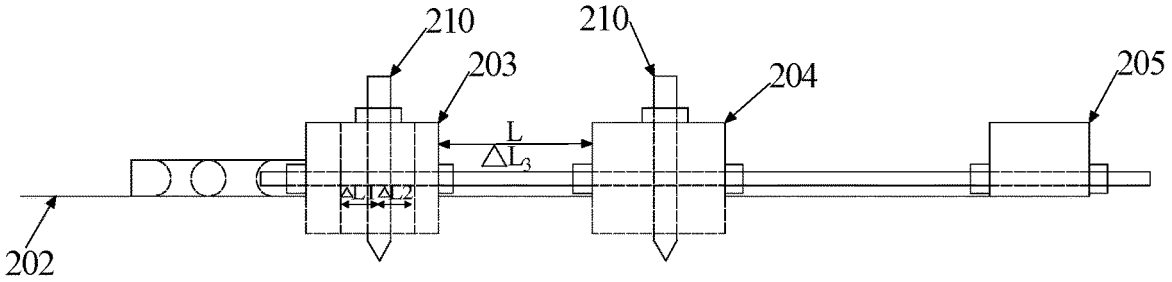
FIG. 12 is a side view showing a connection manner of one end of an anchoring plate of a dual-screw early warning device according to the present invention.

There are various ways to fix the end of the FRP strip 102. In this embodiment, both the fixing plate 101 and the self-locking plate 103 are provided with two strip-shaped grooves parallel to each other, the strip-shaped grooves are used for the FRP strip 102 to pass through, and both ends of the FRP strip 102 are fixedly connected to the fixing plate 101 and the self-locking plate 103 through a self-locking winding structure. Polishing treatment is performed on the strip-shaped grooves, to prevent the FRP strip 102 from being cut off due to stress concentration during winding. As shown in FIG. 7-8, the arrow in the figure shows a sliding tendency of the FRP strip 102 when an external force is pulled. Under the action of the external force $T_0$, the FRP strip 102 will have a movement tendency as shown in the arrow of the figure, and if there is no friction on each of the contact faces, the FRP strip 102 will be pulled out. Because there is frictional resistance between the inner and outer FRP strips 102 and the FRP strips 102 and the steel sheets, they can be self-locking around the screws.

Before both ends of the FRP strip 102 are wound on the fixing plate 101 and the self-locking plate 103, a structural adhesive can be applied to the FRP strip 102 and the oblong holes on the fixing plate 101 and the self-locking plate 103. This mainly considers that the FRP strip 102 has a large width and a small thickness, and generates an eccentric force during installation and assembly, thus causing the side with a large stress to be damaged first, and then the side with a small stress to be damaged. After the structural glue is applied, the bundles of filaments between the FRP strips 102 are integrated as a whole and the force is uniform. The FRP strip 102 is adhered according to the winding direction of FIGS. 7-8, and before the structural adhesive is hardened, the connection position of the FRP strip 102 can be appropriately adjusted to achieve a good connection position, thereby preventing adverse effects such as eccentricity. As the winding thickness of the FRP strip 102 is increased, the connection performance is gradually improved, thereby resolving the problem of loose connection of the FRP strip 102, and achieving a good effect of improving the reinforcement bearing capacity. The FRP strip 102 and the concrete matrix can be in two forms: bonding or non-bonding, which can be selected by those skilled in the art according to actual needs.

To facilitate connection with the FRP strip 102, the self-locking plate 103 is T-shaped and includes a connecting section and a fixing section, where the fixing section is perpendicular to the connecting section and is symmetrical about the connecting section, the connecting section is used for connecting one end of the FRP strip 102, the connecting section is provided with the strip-shaped grooves, and the fixing section is provided with the oblong hole.

To make the overall structure more stable, the center line of the FRP strip 102 coincides with the center line of the tensioning screw 105, so that the FRP strip 102 is approximately at the same height as the tensioning screw 105.

This embodiment further provides a ductility control method for a prestressed FRP reinforced structure. By using the foregoing single-screw early warning device, the specific steps are as follows.

S1. An anchoring plate 104 is fastened on a concrete matrix through an expansion bolt 107;

S2. Both ends of an FRP strip 102 are fastening on a fixing plate 101 and a self-locking plate 103 respectively; and S3. According to the design level of tension stress, a diameter and material of a tensioning screw 105 are selected, the tensioning screw 105 is passed through the anchoring plate 104 and the self-locking plate 103, and the expansion bolt 107 is passed through a midpoint of an oblong hole on the self-locking plate 103 and fastened to the concrete matrix. At this time, a nut 106 on the expansion bolt 107 on the self-locking plate 103 is not tightened, the nut 106 is used to mutually lock the tensioning screw 105 and the self-locking plate 103, at the same time, the nut 106 of the expansion bolt 107 on the fixing plate 101 is tightened, and then a tensioning force is applied. When the tensioning force is pulled to the design level, the nut 106 is used to mutually lock the tensioning screw 105 and the anchoring plate 104, and finally the pulling is stopped.

Step S1-S3 is a prestress design process. After the prestress design is completed, the obtained single-screw early warning device can be used for loading member. During the prestress design, the breaking of the tensioning screw 105 does not occur in the tensioning process of step S3, and the breaking of the tensioning screw 105 only occurs in the member loading process.

In step S2, the FRP strip 102 is preferably fixed to the fixing plate 101 and the self-locking plate 103 by self-locking winding, to improve the connection mode of the FRP strip 102 and improve the reliability of the connection. The specific winding structure is shown in FIG. 7-8.

In step S4, the length of the oblong hole is $\Delta L_1+\Delta L_2$, where $\Delta L_1$ is a distance between the expansion bolt 107 and the left end of the oblong hole, and $\Delta L_2$ is a distance between the expansion bolt 107 and the right end of the oblong hole. As the self-locking plate 103 moves, $\Delta L_1$ and $\Delta L_2$ are constantly changing, with the total length of the both remaining unchanged. When the expansion bolt 107 passes through the midpoint of the oblong hole on the self-locking plate 103 and is fastened on the concrete matrix, $\Delta L_1=\Delta L_2$. When the tensioning screw 105 is pulled to be broken, the self-locking plate 103 gradually moves to the left until it moves to the position of the expansion bolt 107, that is, $\Delta L_2$ on the right side of the expansion bolt 107 becomes zero. Then, the nut 106 of the expansion bolt 107 is tightened, and the expansion bolt 107 plays a role of fastening the self-locking section at this time. The prestressed reinforcement can be converted into a non-prestressed reinforcement, and the structure is still in a safe state, thereby controlling the ductility of the member. There are a variety of traction structures for stretching the tensioning screw 105. This is a conventional means in the art and will not be described herein again.

The length of the oblong hole is more than twice the maximum elongation of the tensioning screw 105, to ensure that the slippage displacement of the self-locking section on the tensioning end is greater than the elongation of the fuse, thereby fully utilizing the elongation of the tensioning screw 105 to improve the ductility of the entire member.

In this embodiment, the tensioning screw 105 is a cylindrical threaded rod cast from ductile materials. The deformation of the tensioning screw 105 is the key to the overall ductility control, the material, diameter, and shape of the tensioning screw 105 can be designed based on the actual reinforcement engineering conditions, to meet the needs of different types of reinforcement engineering. The material of the tensioning screw is preferably a shape memory alloy, the shape memory alloy has the advantage of being fatigue-resistant, and the shape memory alloy has characteristics that after plastic deformation occurs, the shape before deformation can be restored after a suitable thermal process. Therefore, the tensioning screw 105 in this embodiment can be restored to the original state by heating, and the recycling of the tensioning screw can be realized, which can save the cost significantly, and can also be replaced after pulling to be broken, without affecting the use of the entire tensioning structure.

Embodiment 3

As shown in FIG. 9-18, this embodiment provides a dual-screw early warning device for a prestressed FRP reinforced structure, which includes a fixing plate 201, an FRP strip 202, a self-locking plate 203, an anchoring plate 204, a tensioning plate 205, a tensioning screw, a nut 209, and an expansion bolt 210. The tensioning screw includes a first tensioning screw 206 and a second tensioning screw 207 disposed in parallel with equal height. The fixing plate 201, the self-locking plate 203, and the anchoring plate 204 are all low carbon steel structures. The FRP strip 202 is used for connecting the fixing plate 201 and the self-locking plate 203. The tensioning screw is used for connecting the self-locking plate 203, the anchoring plate 204, and the tensioning plate 205. The nut 209 is connected to the tensioning screw in a screw thread manner. The nut 209 is used to respectively lock the tensioning screw with the self-locking plate 203, the anchoring plate 204, and the tensioning plate 205. The expansion bolt 210 is used to fasten the fixing plate 201, the self-locking plate 203, and the anchoring plate 204 on the concrete matrix.

The fixing plate 201, the self-locking plate 203, the anchoring plate 204, and the tensioning plate 205 are respectively disposed from the left to right. One end of the FRP strip 202 is fixedly connected to the fixing plate 201, and the other end of the FRP strip 202 is fixedly connected to the self-locking plate 203. The tensioning screw passes through the self-locking plate 203, the anchoring plate 204, and the tensioning plate 205. There are a plurality of nuts 209 used for locking the tensioning screws on both sides of the self-locking plate 203, on both sides of the anchoring plate 204, and on both sides of the tensioning plate 205. The through-hole for mounting the expansion bolt 210 on the self-locking plate 203 is an oblong hole, and the oblong hole is disposed in parallel with the tensioning screw. The length of the oblong hole is more than twice the maximum elongation of the tensioning screw, which aims to fully exert the deformation of the tensioning screw, to fully utilize the elongation of the tensioning screw to improve the ductility of the entire member.

Figure 17:
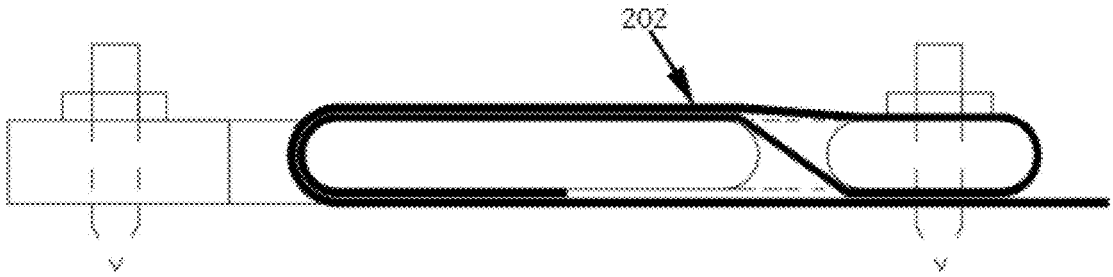
FIG. 17 is a schematic diagram showing a fixing manner of an FRP strip on one end of a fixing plate of a dual-screw early warning device according to the present invention.
Figure 18:
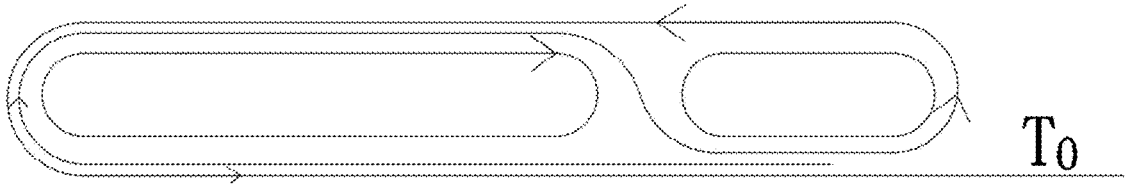
FIG. 18 is a simplified schematic diagram of FIG. 17.

There are various ways to fix the end of the FRP strip 202. In this embodiment, both the fixing plate 201 and the self-locking plate 203 are provided with two strip-shaped grooves parallel to each other, the strip-shaped grooves are used for the FRP strip 202 to pass through, and both ends of the FRP strip 202 are fixedly connected to the fixing plate 201 and the self-locking plate 203 through a self-locking winding structure. Polishing treatment is performed on the strip-shaped grooves, to prevent the FRP strip 202 from being cut off due to stress concentration during winding. As shown in FIG. 17-18, the arrow in the figure shows a sliding tendency of the FRP strip 202 when an external force is pulled. Under the action of the external force $T_0$, the FRP strip 202 will have a movement tendency as shown in the arrow of the figure, and if there is no friction on each of the contact faces, the FRP strip 202 will be pulled out. Because there is frictional resistance between the inner and outer FRP strips 202 and the FRP strips 202 and the steel sheets, they can be self-locking around the screws.

Before both ends of the FRP strip 202 are wound on the fixing plate 201 and the self-locking plate 203, a structural adhesive can be applied to the FRP strip 202 and the oblong holes on the fixing plate 201 and the self-locking plate 203. This mainly considers that the FRP strip 202 has a large width and a small thickness, and generates an eccentric force during installation and assembly, thus causing the side with a large stress to be damaged first, and then the side with a small stress to be damaged. After the structural glue is applied, the bundles of filaments between the FRP strips 202 are integrated as a whole and the force is uniform. The FRP strip 202 is adhered according to the winding direction of FIGS. 17-18, and before the structural adhesive is hardened, the connection position of the FRP strip 202 can be appropriately adjusted to achieve a good connection position, thereby preventing adverse effects such as eccentricity. As the winding thickness of the FRP strip 202 is increased, the connection performance is gradually improved, thereby resolving the problem of loose connection of the FRP strip 202, and achieving a good effect of improving the reinforcement bearing capacity. The FRP strip 202 and the concrete matrix can be in two forms: bonding or non-bonding, which can be selected by those skilled in the art according to actual needs.

To facilitate connection with the FRP strip 202, the self-locking plate 203 is T-shaped and includes a connecting section and a fixing section, where the fixing section is perpendicular to the connecting section and is symmetrical about the connecting section, the connecting section is used for connecting one end of the FRP strip 202, the connecting section is provided with the strip-shaped grooves, and the fixing section is provided with the oblong hole.

To make the overall structure more stable, the horizontal distance between the center line of the FRP strip 202 and the first tensioning screw 206 is equal to the horizontal distance between the center line of the FRP strip 202 and the second tensioning screw 207, and the FRP strip 202 is approximately at the same height as the tensioning screw, so that the center line of the FRP strip 202 and the resultant center line of the tensioning screw are coincident.

Figure 6:
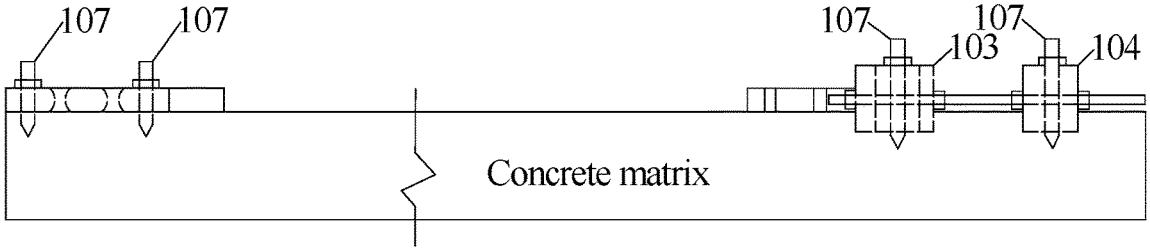
FIG. 6 is a side view of a single-screw early warning device according to the present invention.
Figure 14:
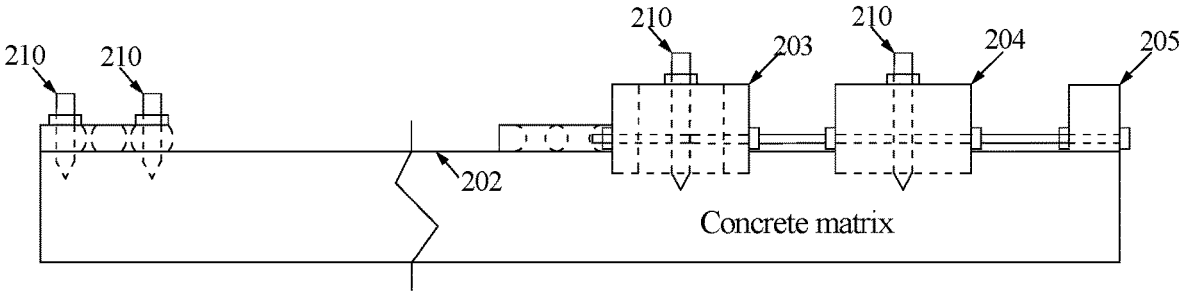
FIG. 14 is a side view of a dual-screw early warning device according to the present invention.
Figure 16:
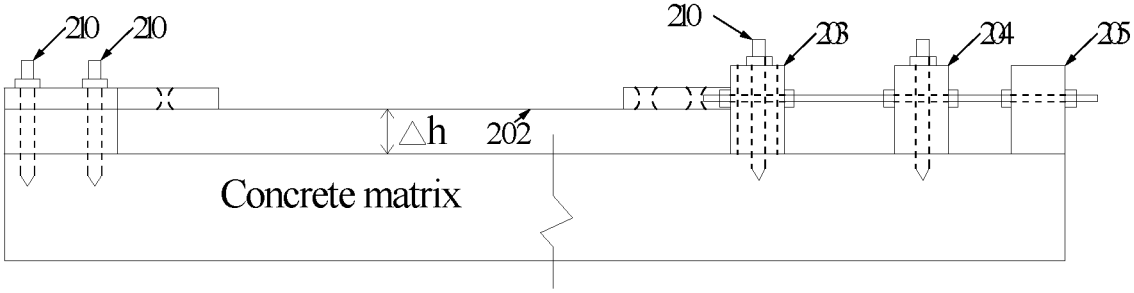
FIG. 16 is a side view of an improved dual-screw early warning device according to the present invention.
Figure 20:
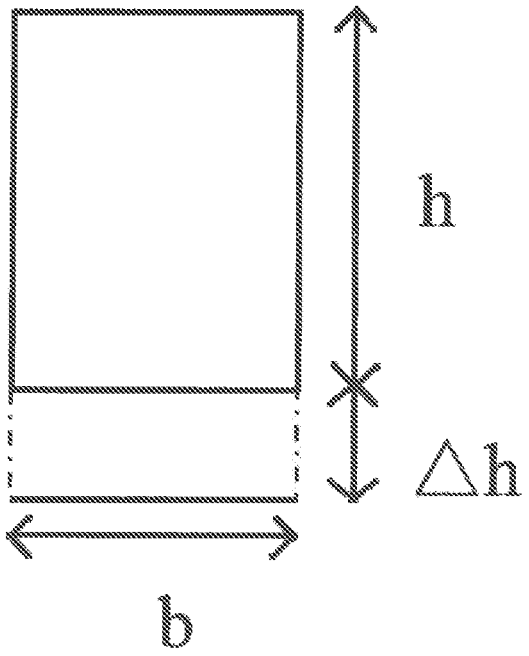
FIG. 20 is a cross-sectional schematic diagram showing a beam with an improved mounting method of a single-screw early warning device and a dual-screw early warning device according to the present invention.

It should be noted that the FRP strips 202 and the tensioning screws in FIG. 6 of Embodiment 2 and FIG. 14 in Embodiment 3 are installed in a bonding manner of being attached to the concrete matrix. This manner is not a preferred installation method, and the distance between the FRP strip 202 and the concrete matrix can be adjusted according to actual needs. The cross-sectional schematic diagram of the beam with an improved mounting method is shown in FIG. 16 and FIG. 20. The FRP strip 202 and the tensioning screw are preferably at a certain height (Δh) from the concrete matrix. As Δh increases, the height of the calculated section can be increased, thereby increasing the moment of inertia of the section, and increasing the bending stiffness. The specific descriptions are as follows.

Prestressed carbon fiber flexural members are obtained according to the Code For Design Of Strengthening Concrete Structure (GB50367-2013):

(1) Bending members without cracks:

$$B_s=0.85E_cI_0$$

(2) Bending members with cracks:

$$B_s = \frac{0.85E_cI_0}{k_{cr}+(1-k_{cr})\omega}.$$

Note: $B_s$ is bending stiffness, and $I_0$ is moment of inertia.

$$I_0 = \frac{bh^3}{12}$$

$$I_1 = \frac{b(h+\Delta h)^3}{12}$$

$$\Delta I = I_1 - I_0 = \frac{b(h+\Delta h)^3}{12} - \frac{bh^3}{12}$$

Therefore, the bending stiffness $B_s$ increases as the section moment of inertia ($I_0$) increases. $I_0$ is the moment of inertia of an unreinforced beam cross section, $I_1$ is the moment of inertia of a beam cross section with the installation method improved, and ΔI is the increased moment of inertia. It can be learned from the above formula that ΔI increases as Δh increases, so this installation scheme can increase ΔI by increasing Δh, and increase $B_s$ by increasing ΔI.

This embodiment further provides a ductility control method for a prestressed FRP reinforced structure. By using the foregoing dual-screw early warning device, the specific steps are as follows.

51. An anchoring plate 204 is fastened on a concrete matrix through an expansion bolt 210; S2. Both ends of an FRP strip 202 are fastening on a fixing plate 201 and a self-locking plate 203 respectively; and S3. According to the design level of tension stress, a diameter and material of a tensioning screw are selected, the tensioning screw is passed through the self-locking plate 203, the anchoring plate 204, and the tensioning plate 205, a nut 209 is used to mutually lock the tensioning screw and the self-locking plate 203, and the nut 209 is used to mutually lock the tensioning screw and the tensioning plate 205;

S4. A distance between the tensioning plate 205 and the anchoring plate 204 is enlarged, thereby pulling the tensioning screw, when the tensioning force is pulled to the design level, the nut 209 is used to mutually lock the tensioning screw and the anchoring plate 204, and finally the pulling is stopped; and S5. The self-locking plate 203 is fastened on concrete matrix by using the expansion bolt 210, the expansion bolt 210 is fastened on the center of the oblong hole of the self-locking plate 203, meanwhile, the expansion bolt 210 is not locked and tightened.

Step S1-S5 is a prestress design process. After the prestress design is completed, the obtained dual-screw early warning device can be used for loading member. During the prestress design, the breaking of the tensioning screw does not occur in the tensioning process of step S4, and the breaking of the tensioning screw only occurs in the member loading process.

Figure 21:
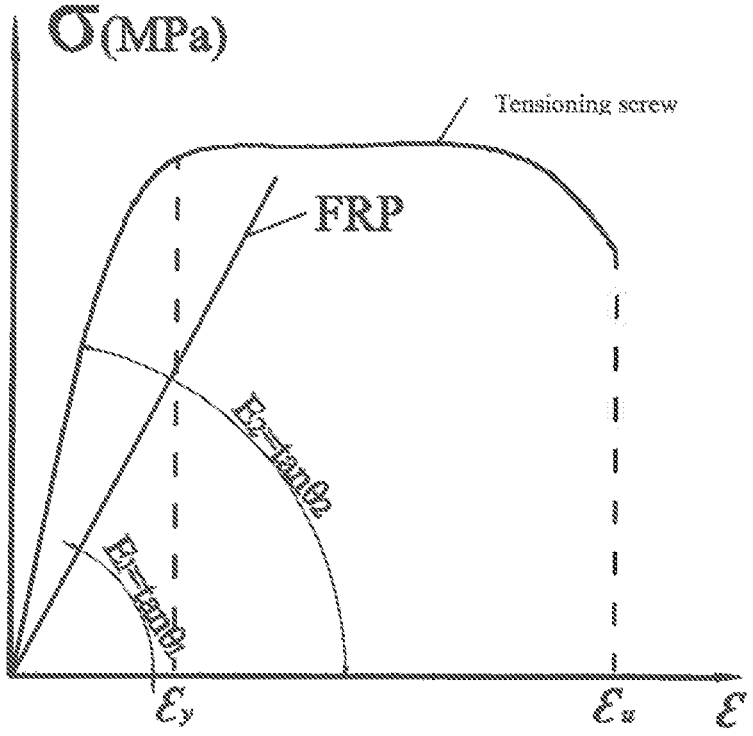
FIG. 21 is a curve showing stress-strain of an FRP strip and a tensioning screw.

In order to improve the ductility of the structure and achieve the self-warning function of the structure, the tensioning screws in Embodiment 2 and Embodiment 3 should be made of a material having elastoplastic deformation ability (FIG. 21). It is required that the elastic modulus ($E_2$) of the tensioning screw is greater than or equal to the elastic modulus ($E_1$) of the FRP, and the ratio of its fracture deformation ($\Sigma_u$ as shown in FIG. 21) to plastic deformation (c as shown in FIG. 21), that is $\Sigma_0/\varepsilon_y$, should meet the structural ductility requirements.

In Embodiment 2 and Embodiment 3, the tensioning screw has the same early warning function as the "fuse" during use, and the tensioning screw has the functions of being "replaceable" and "recoverable" and makes early warning of the entire prestressing reinforcement process by detecting the elongation of the tensioning screw. Since the tensioning screw is a plastic material, when the tensioning screw is pulled to a certain level, the load is almost unchanged, the deformation of the tensioning screw continues to increase, with the deformation amount reaching a certain level, namely, the tensioning screw failed, therefore, the tensioning screw can be replaced for performing prestressed reinforcement again.

In step S2, the FRP strip 202 is preferably fixed to the fixing plate 201 and the self-locking plate 203 by self-locking winding, to improve the connection mode of the FRP strip 202 and improve the reliability of the connection. The specific winding structure is shown in FIG. 17-18.

In step S5, the length of the oblong hole is $\Delta L_1+\Delta L_2$, where $\Delta L_1$ is a distance between the expansion bolt 210 and the left end of the oblong hole, and $\Delta L_2$ is a distance between the expansion bolt 210 and the right end of the oblong hole. As the self-locking plate 203 moves, $\Delta L_1$ and $\Delta L_2$ are constantly changing, with the total length of the both remaining unchanged. When the expansion bolt 210 passes through the midpoint of the oblong hole on the self-locking plate 203 and is fastened on the concrete matrix, $\Delta L_1=\Delta L_2$. When the first tensioning screw 206 and the second tensioning screw 207 are pulled to be broken, the self-locking plate 203 gradually moves to the left until it moves to the position of the expansion bolt 210, that is, $\Delta L_2$ on the right side of the expansion bolt 210 becomes zero. Then, the nut 209 of the expansion bolt 210 is tightened, and the expansion bolt 210 plays a role of fastening the self-locking section at this time. The prestressed reinforcement can be converted into a non-prestressed reinforcement, and the structure is still in a safe state, thereby controlling the ductility of the member.

Figure 13:
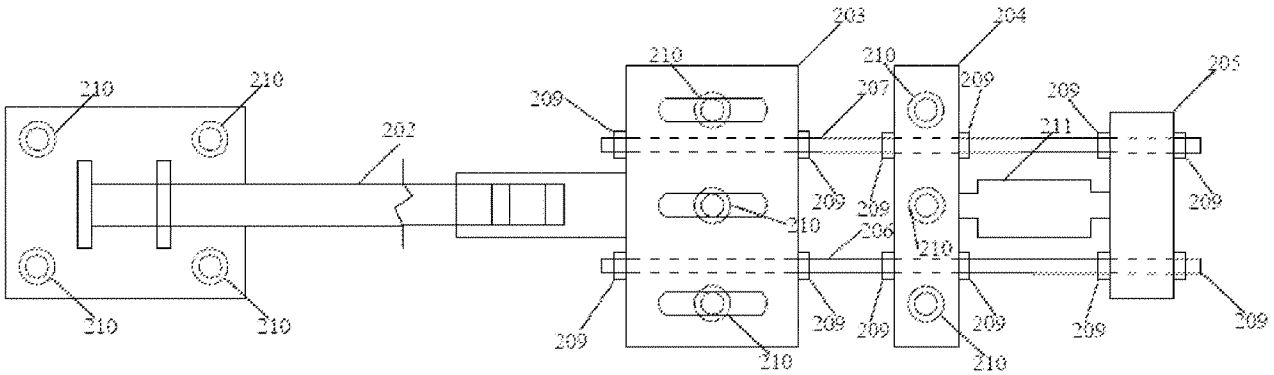
FIG. 13 is a top view of a dual-screw early warning device according to the present invention.
Figure 15:
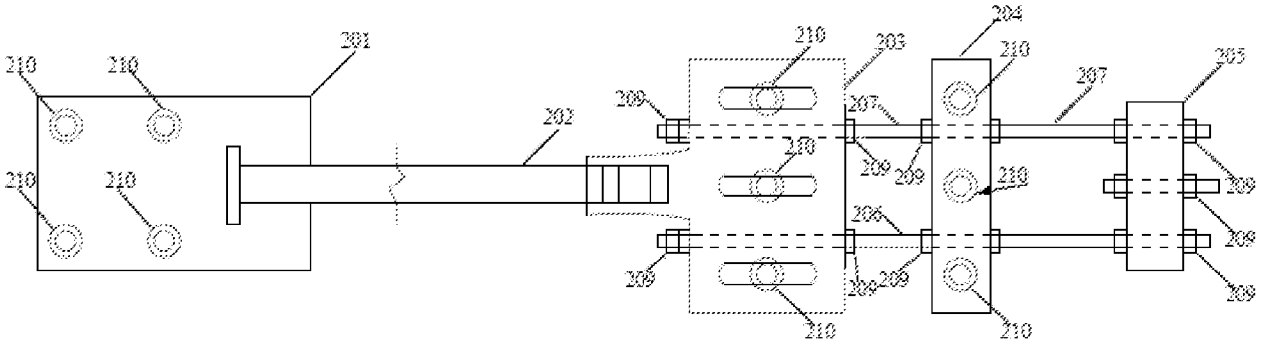
FIG. 15 is a top view of an improved dual-screw early warning device according to the present invention.

There are various traction structures for stretching the tensioning screw, as shown in FIG. 13-14, the distance between the tensioning plate 205 and the anchoring plate 204 can be enlarged by the hydraulic jack 211, thereby achieving the stretching of the tensioning screw. Further, as shown in FIG. 15-16, the third tensioning screw 208 can pass through the tensioning plate 205, the nut 209 can be used to lock the third tensioning screw 208 and the tensioning plate 205 with each other, and the distance between the tensioning plate 205 and the anchoring plate 204 is enlarged by pulling one end of the third tensioning screw 208 away from the anchoring plate 204, thereby realizing the stretching of the tensioning screw.

The length of the oblong hole is more than twice the maximum elongation of the tensioning screw, to ensure that the slippage displacement of the self-locking section on the tensioning end is greater than the elongation of the fuse, thereby fully utilizing the elongation of the tensioning screw to improve the ductility of the entire member.

Figure 19:
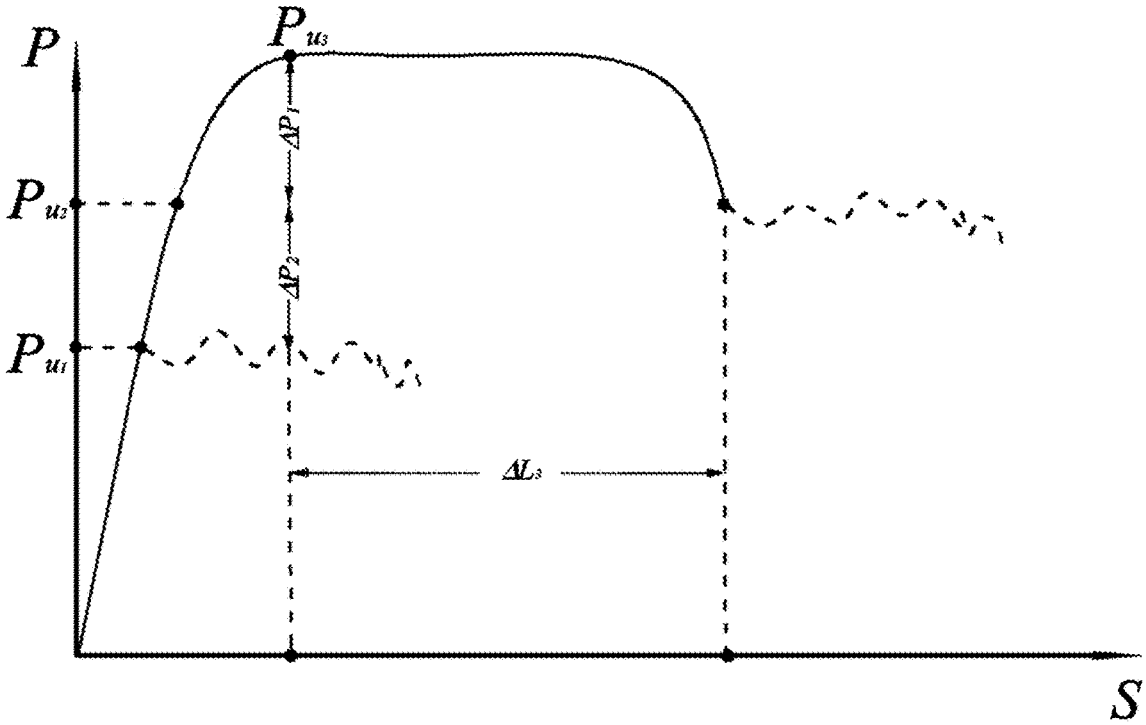
FIG. 19 is a schematic diagram showing a load-slip curve of a reinforced beam.

The load-slip curve of the reinforced beam of Embodiment 2 and Embodiment 3 of the present invention is shown in FIG. 19. $P_{u3}$ is the bearing capacity after the prestress is applied, and $P_{u2}$ is the bearing capacity after the self-locking section of the tensioning end is anchored by the expansion bolt when the prestress is removed or it can also be considered that the bearing capacity corresponding to the tension of the tension screw is broken. $P_{u1}$ is the bearing capacity of ordinary concrete members, $\Delta P_1$ is the portion where the prestress is applied, $\Delta P_2$ is the bearing capacity of the carbon fiber reinforced member after the prestress is removed, and $\Delta L_3$ is the elongation of the tensioning screw. As can be learned from FIG. 19, the tensioning device and the tensioning method provided in the embodiments can significantly improve the ductility of the prestressed structure, and realize the ductility controllable design. The prestressed reinforcement can be converted into non-prestressed reinforcement when tensioning screw failure occurs, and the structure is still in a safe state. It should be noted that the conventional prestressed reinforcement is to increase the early stiffness of the members at the expense of ductility, while the embodiments not only improve the early stiffness of the members, but also improve the ductility of the members, and increase the safety of the members.

In Embodiment 2 and Embodiment 3, the tensioning screw is a cylindrical threaded rod cast from ductile materials. The deformation of the tensioning screw is the key to the overall ductility control, the material, diameter, and shape of the tensioning screw can be designed based on the actual reinforcement engineering conditions, to meet the needs of different types of reinforcement engineering. The material of the tensioning screw is preferably a shape memory alloy, the shape memory alloy has the advantage of being fatigue-resistant, and the shape memory alloy has characteristics that after plastic deformation occurs, the shape before deformation can be restored after a suitable thermal process. Therefore, the tensioning screw in this embodiment can be restored to the original state by heating, and the recycling of the tensioning screw can be realized, which can save the cost significantly, and can also be replaced after pulling to be broken, without affecting the use of the entire tensioning structure.

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the invention.

What is claimed is:

1. A tensioning screw early warning device for a prestressed FRP reinforced structure, comprising a fixing plate, an FRP strip having a first end and a second end, a self-locking plate having two sides, an anchoring plate having two sides that are oriented in a same direction as the two sides of the self-locking plate, at least one tensioning screw, a plurality of nuts and expansion bolts, wherein the fixing plate and the anchoring plate are located on the two sides of the self-locking plate; the first end of the FRP strip is fixedly connected to the fixing plate, and the second end of the FRP strip is fixedly connected to the self-locking plate; the at least one tensioning screw passes through the self-locking plate and the anchoring plate; the plurality of nuts are in threaded connection to the tensioning screw, and the plurality of nuts are configured to lock on the two sides of the self-locking plate and on the two sides of the anchoring plate; the expansion bolts are configured to fasten the fixing plate, the self-locking plate, and the anchoring plate on a concrete matrix; and a through hole for mounting one of the expansion bolts that is on the self-locking plate is an oblong hole, and the oblong hole is disposed in parallel with the tensioning screw.

2. A single-screw early warning device for a prestressed FRP reinforced structure, comprising a fixing plate, an FRP strip having a first end and a second end, a self-locking plate having two sides, an anchoring plate having two sides having two sides that are oriented in a same direction as the two sides of the self-locking plate, a tensioning screw, a plurality of nuts and expansion bolts, wherein the fixing plate and the anchoring plate are located on the two sides of the self-locking plate; the first end of the FRP strip is fixedly connected to the fixing plate, and the second end of the FRP strip is fixedly connected to the self-locking plate; the tensioning screw passes through the self-locking plate and the anchoring plate; the plurality of nuts are in threaded connection to the tensioning screw, and the plurality of nuts are configured to lock on the sides of the self-locking plate and on the two sides of the anchoring plate; the expansion bolts are configured to fasten the fixing plate, the self-locking plate, and the anchoring plate on a concrete matrix; and a through hole for mounting one of the expansion bolts that is on the self-locking plate is an oblong hole, and the oblong hole is disposed in parallel with the tensioning screw.

3. The single-screw early warning device for a prestressed FRP reinforced structure according to claim 2, wherein both the fixing plate and the self-locking plate are provided with two strip-shaped grooves parallel to each other, the strip-shaped grooves are used for the FRP strip to pass through, and the first and second ends of the FRP strip are respectively fixedly connected to the fixing plate and the self-locking plate through a self-locking winding structure.

4. The single-screw early warning device for a prestressed FRP reinforced structure according to claim 3, wherein the self-locking plate is T-shaped and comprises a connecting section and a fixing section, wherein the fixing section is perpendicular to the connecting section and is symmetrical about the connecting section, the connecting section is used for connecting the first end of the FRP strip to the fixing plate, the connecting section is provided with the strip-shaped grooves, and the fixing section is provided with the oblong hole.

5. The single-screw early warning device for a prestressed FRP reinforced structure according to claim 3, wherein an edge of the FRP strip is a smooth transition structure.

6. The single-screw early warning device for a prestressed FRP reinforced structure according to claim 2, wherein a center line of the FRP strip coincides with a center line of the tensioning screw.

7. The single-screw early warning device for a prestressed FRP reinforced structure according to claim 2, wherein a length of the oblong hole is greater than twice a maximum elongation of the tensioning screw.

8. A ductility control method for a prestressed FRP reinforced structure, characterized by using the single-screw early warning device according to claim 2 and comprising:

S1. fastening the anchoring plate on the concrete matrix through the expansion bolt;

S2. fastening the first and second ends of the FRP strip on the fixing plate and the self-locking plate respectively; and S3. passing the tensioning screw through the anchoring plate and the self-locking plate, passing one of the expansion bolts through a midpoint of an oblong hole on the self-locking plate and fastening the tensioning screw to the concrete matrix, using a first of the nuts which is on said one of the expansion bolts to mutually lock the tensioning screw and the self-locking plate without tightening the first nut on the self-locking plate and, at the same time, tightening a second one of the nuts which is on said one of the expansion bolts on the fixing plate, then, while applying a predetermined range of tensioning force, using a third one of the nuts to mutually lock the tensioning screw and the anchoring plate; and then stopping application of the predetermined range of tensioning force.

9. The ductility control method for a prestressed FRP reinforced structure according to claim 8, wherein step S2 both includes fastening the first and second ends of the FRP strip respectively on the fixing plate and the self-locking plate through in a self-locking winding manner.

10. A dual-screw early warning device for a prestressed FRP reinforced structure, comprising a fixing plate, an FRP strip having a first end and a second end, a self-locking plate having two sides, an anchoring plate having two sides that are oriented in a same direction as the two sides of the self-locking plate, a tensioning plate having two sides that are oriented in a same direction as the two sides of the self-locking plate, a tensioning screw, a plurality of nuts and expansion bolts, wherein the tensioning plate comprises a first tensioning plate and a second tensioning plate arranged in parallel; the fixing plate, the self-locking plate, the anchoring plate, and the tensioning plate are sequentially arranged from left to right; the first end of the FRP strip is fixedly connected to the fixing plate, and the second end of the FRP strip is fixedly connected to the self-locking plate; the tensioning screw passes through the self-locking plate, the anchoring plate, and the tensioning plate; the plurality of nuts are in threaded connection to the tensioning screw, and the plurality of nuts are configured to lock on the two sides of the self-locking plate, on the two sides of the anchoring plate, and on the two sides of the tensioning plate; the expansion bolts are configured to fasten the fixing plate, the self-locking plate, and the anchoring plate on a concrete matrix; and a through hole for mounting one of the expansion bolts that is on the self-locking plate is an oblong hole, and the oblong hole is disposed in parallel with the tensioning screw.

11. The dual-screw early warning device for a prestressed FRP reinforced structure according to claim 10, wherein both the fixing plate and the self-locking plate are provided with two strip-shaped grooves parallel to each other, the strip-shaped grooves are used for the FRP strip to pass through, and the first and second ends of the FRP strip are fixedly connected to the fixing plate and the self-locking plate through a self-locking winding structure.

12. The dual-screw early warning device for a prestressed FRP reinforced structure according to claim 11, wherein the self-locking plate is T-shaped and comprises a connecting section and a fixing section, wherein the fixing section is perpendicular to the connecting section and is symmetrical about the connecting section, the connecting section is used for connecting the first end of the FRP strip to the fixing plate, the connecting section is provided with the strip-shaped grooves, and the fixing section is provided with the oblong hole.

13. The dual-screw early warning device for a prestressed FRP reinforced structure according to claim 11, wherein an edge of the FRP strip is a smooth transition structure.

14. The dual-screw early warning device for a prestressed FRP reinforced structure according to claim 10, wherein a center line of the FRP strip coincides with a center line of the tensioning screw.

15. The dual-screw early warning device for a prestressed FRP reinforced structure according to claim 10, wherein a length of the oblong hole is greater than twice a maximum elongation of the tensioning screw.

16. A ductility control method for a prestressed FRP reinforced structure, characterized by using the dual-screw early warning device according to claim 10 and comprising:

S1. fastening the anchoring plate on the concrete matrix through one of the expansion bolts;

S2. fastening the first and second ends of the FRP strip on the fixing plate and the self-locking plate respectively; and S3. passing the tensioning screw through the self-locking plate, the anchoring plate, and the tensioning plate, mutually locking the tensioning screw and the self-locking plate by a first one of the nuts, and mutually locking the tensioning screw and the tensioning plate by a second one of the nuts;

S4. enlarging distance between the tensioning plate and the anchoring plate, thereby pulling the tensioning screw to apply a predetermined range of tensioning force, and mutually locking the tensioning screw and the anchoring plate by a third one of the nuts, and finally stopping the pulling; and S5. mounting said one of the expansion bolts on the concrete matrix through the oblong hole of the self-locking plate, centering the expansion bolt in the oblong hole of the self-locking plate while said one the expansion bolt is unlocked and untightened, and then fastening the expansion bolt while centered in the oblong hole.

17. The method for improving ductility of the FRP reinforced structure and achieving overload early warning according to claim 16, wherein step S2 includes fastening the first and second ends of the FRP strip respectively on the fixing plate and the self-locking plate in a self-locking winding manner.

18. The ductility control method for a prestressed FRP reinforced structure according to claim 16, wherein step S4 includes enlarging the distance between the tensioning plate and the anchoring plate by a hydraulic jack.

19. The ductility control method for a prestressed FRP reinforced structure according to claim 16, wherein step S4 includes passing a third tensioning screw through the tensioning plate and and mutually locking the third tensioning screw and the tensioning plate by a fourth one of the nuts, and enlarging the distance between the tensioning plate and the anchoring plate by pulling one end of the third tensioning screw away from the anchoring plate.

* * * * *